US009482408B2

(12) United States Patent
Catalano

(10) Patent No.: US 9,482,408 B2
(45) Date of Patent: Nov. 1, 2016

(54) LIGHT SOURCE FOR UNIFORM ILLUMINATION OF AN AREA

(71) Applicant: TerraLUX, Inc., Longmont, CO (US)

(72) Inventor: Anthony W. Catalano, Boulder, CO (US)

(73) Assignee: TerraLUX, Inc., Longmont, CO (US)

( * ) Notice: Subject to any disclaimer, the term of this patent is extended or adjusted under 35 U.S.C. 154(b) by 323 days.

(21) Appl. No.: 14/297,672

(22) Filed: Jun. 6, 2014

(65) Prior Publication Data

US 2015/0354781 A1 Dec. 10, 2015

(51) Int. Cl.

| | |
|---|---|
| ***F21V 7/08*** | (2006.01) |
| ***F21V 7/00*** | (2006.01) |
| *F21Y 101/02* | (2006.01) |
| *F21Y 103/00* | (2016.01) |
| *F21V 7/04* | (2006.01) |

(52) U.S. Cl.

CPC ..... *F21V 7/08* (2013.01); *F21V 7/005* (2013.01); *F21V 7/0033* (2013.01); *F21V 7/048* (2013.01); *F21Y 2101/02* (2013.01); *F21Y 2103/003* (2013.01)

(58) Field of Classification Search

CPC ..... F21V 7/08; F21V 7/0033; F21V 7/005; F21V 7/048

See application file for complete search history.

(56) References Cited

U.S. PATENT DOCUMENTS

| | | | | |
|---|---|---|---|---|
| 4,748,543 | A * | 5/1988 | Swarens | F21S 8/02 362/147 |
| 4,897,771 | A | 1/1990 | Parker | |
| 5,142,459 | A * | 8/1992 | Swarens | F21V 7/0008 362/147 |
| 5,491,620 | A | 2/1996 | Winston et al. | |
| 7,178,947 | B2 | 2/2007 | Marks | |
| 7,212,347 | B2 | 5/2007 | Pentico et al. | |
| 7,658,513 | B2 | 2/2010 | Peck | |
| 8,506,128 | B2 | 8/2013 | Sakata et al. | |

FOREIGN PATENT DOCUMENTS

| | | | |
|---|---|---|---|
| EP | 0691552 | A2 | 1/1996 |
| WO | 95/04240 | A1 | 2/1995 |
| WO | 01/73487 | A2 | 10/2001 |
| WO | 02/14925 | A2 | 2/2002 |
| WO | 2007/113768 | A2 | 10/2007 |

* cited by examiner

*Primary Examiner* — Mary Ellen Bowman

(74) *Attorney, Agent, or Firm* — Neugeboren O'Dowd PC

(57) ABSTRACT

A light source (e.g., a linear LED array or other light-emitting devices) may be coupled with multiple reflectors for providing uniform illumination on a target surface.

18 Claims, 9 Drawing Sheets

LIGHT SOURCE FOR UNIFORM ILLUMINATION OF AN AREA

TECHNICAL FIELD

The present invention relates to illumination devices including reflective optics for uniformly illuminating a surface.

BACKGROUND

For many applications, it is desirable to have a light device that produces uniform illumination at and across a planar surface. Conventionally, with reference to FIGS. 1A and 1B, one approach utilizes parabolic optics 102 coupled to a light source 104 for capturing light emitted from the light source 104 and redistributing the light to generate a more homogeneous illumination distribution across the target region. Although the parabolic reflectors successfully capture a large portion of light from the source, the degree of illumination homogeneity generated by the parabolic reflector is unsatisfactory. For example, FIG. 1B shows several "hot spots" in a contour plot of illumination on a plane of area 2×2 $m^2$ illuminated by the light device having the parabolic optics 102.

Referring to FIGS. 2A and 2B, another conventional strategy utilized for producing uniform illumination utilizes a V-shaped flat reflector 202 partially surrounding a light source (typically a fluorescent tube) 204. Although this light device may appear to provide improved illumination homogeneity (i.e., approximately 3:1 illumination variation across a region of area 2×2 $m^2$) at a distance far from the device (e.g., 2 meters), at a shorter distance (e.g., 30 centimeters) from the light device, the illumination variation across the 2×2 $m^2$ region, however, remains unsatisfactory (i.e., approximately 10:1) as illustrated in FIG. 2B. Additionally, placing the light device far away from the target region to improve the illumination homogeneity sacrifices overall intensity, thereby resulting in energy waste.

Accordingly, there is a need for illumination devices that effectively and efficiently illuminate a desired region uniformly.

SUMMARY

The present invention provides illumination devices that utilize two or more reflectors facing each other to distribute light received from one or more light sources over a target surface uniformly. In various embodiments, the reflectors include a primary and a secondary reflector, each having at least one segment with an elliptical surface profile. Each elliptical segment has two geometrical conjugate foci light emitted from one focus, after reflection by the segment, passes through the other focus. Thus, placing the light source coincident with the first focus of the primary reflector results in light passing through the second focus, which is located between the primary and secondary reflectors. In one embodiment, the secondary reflector includes multiple elliptical segments sharing a common focus; their other foci are distributed over the target surface. The secondary reflector can be placed far from the light source and the second focus of the primary reflector (e.g., the distance between the secondary reflector and the light source is at least three times the distance between the second focus of the primary reflector and the light source) such that the light source and the second focus of the primary reflector may be substantially co-located at the common focus of the elliptical segments of the secondary reflector. Accordingly, light emitted from the light source directly onto the secondary reflector as well as light reflected from the primary reflector may be directed to the foci of the secondary reflector that are distributed over the target surface; this results in uniform illumination on the target surface. Because elliptical reflectors collect a higher fraction of light than conventional spherical or parabolic optics, light emitted from the light source can be effectively collected and redirected. Additionally, utilization of the two or more reflectors may capture almost all light emitted from the light source, thereby providing nearly complete energy transfer and redistribution on the target surface.

Accordingly, in one aspect, the invention pertains to a device for uniform illumination of a target surface. In various embodiments, the device includes a linear light source; a primary reflector extending parallel to at least a portion of the linear light source and having a substantially constant transverse cross-section; and facing the primary reflector and extending parallel to at least a portion of the linear light source, a secondary reflector having a substantially constant transverse cross-section. The light source, the primary reflector, and the secondary reflector are arranged such that the primary reflector directly intercepts and reflects the first portion of light emitted by the light source to cause substantially uniform illumination of the secondary reflector, and the secondary reflector directly intercepts and reflects the second portion of light emitted by the light source as well as the light intercepted and reflected by the primary reflector to cause substantially uniform illumination of the target surface. The target surface may be planar. In one implementation, the light source includes a linear arrangement of light-emitting diodes.

The primary reflector may include one or more elliptical segments having a focus coincident with the light source. The secondary reflector may include multiple elliptical segments having a common first focus located at the light source and different second foci distributed over the target surface. In one embodiment, the primary reflector includes multiple elliptical segments that have a common focus coincident with the light source and different second foci distributed over the secondary reflector, thereby causing substantially uniform illumination of the secondary reflector. The second foci of the primary reflector may form a line that is approximately tangent to the curve of the secondary reflector. In one implementation, each segment of the primary reflector directs light from the light source onto a corresponding segment of the secondary reflector; different segments of the primary reflector direct the light onto different segments of the secondary reflector.

In various embodiments, the common first focus of the secondary reflector is located substantially at the light source and also at the primary reflector. The distance between the secondary reflector and the light source may exceed a distance between the primary reflector and the light source by a factor of at least three. The segments of the primary reflector and the secondary reflector may be sized, curved, and oriented to cause uniform illumination of the target surface. Additionally, the primary and secondary reflectors may be configured such that the first and second portions of light collectively amount to substantially all the light emitted by the light source into a half sphere. For example, each of the primary and secondary reflectors may subtend an angle of approximately 90°, measured from the center of the light source, thereby intercepting about half of the light emitted by the light source. In one embodiment, the reflective surface area of the primary reflector is less than one-third of a reflective surface area of the secondary reflector.

In another aspect, the invention relates to a method for uniform illumination of a target surface. In various embodiments, the method includes directly intercepting and reflecting the first portion of light emitted by a light source, using a primary reflector, to cause substantially uniform illumination of the reflective surface of a secondary reflector; and directly intercepting and reflecting the second portion of light emitted by the light source as well as the light intercepted and reflected by the primary reflector, using the secondary reflector, to cause substantially uniform illumination of the target surface. The secondary reflector may include multiple foci distributed over the target surface, thereby causing substantially uniform illumination of the target surface. In addition, the primary reflector may include multiple foci distributed over the secondary reflector, thereby causing uniform illumination of the reflective surface of the secondary reflector.

In some embodiments, each of the primary and secondary reflectors intercepts about half of the light emitted by the light source, and the first and second portions of light collectively amount to substantially all the light emitted by the light source into a half sphere.

The term "uniform," as used herein, refers to a light intensity distribution whose lower and upper intensity limits are within a factor of four, preferably within a factor of two of each other. As used herein, the terms "approximately," "roughly," and "substantially" mean ±10%, and in some embodiments, ±5%. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. The headings provided herein are for convenience only and are not intended to limit or interpret the scope or meaning of the claimed technology.

BRIEF DESCRIPTION OF THE DRAWINGS

The foregoing will be more readily understood from the following detailed description of the invention, in particular, when taken in conjunction with the drawings, in which.

DETAILED DESCRIPTION

Figure 1A:
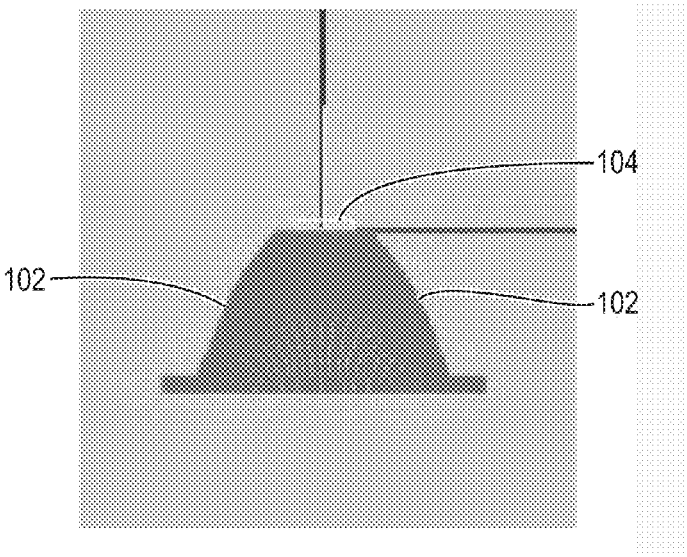
FIGS. 1A and 1B illustrate a prior art light device and a contour plot of illumination generated thereby, respectively.
Figure 1B:
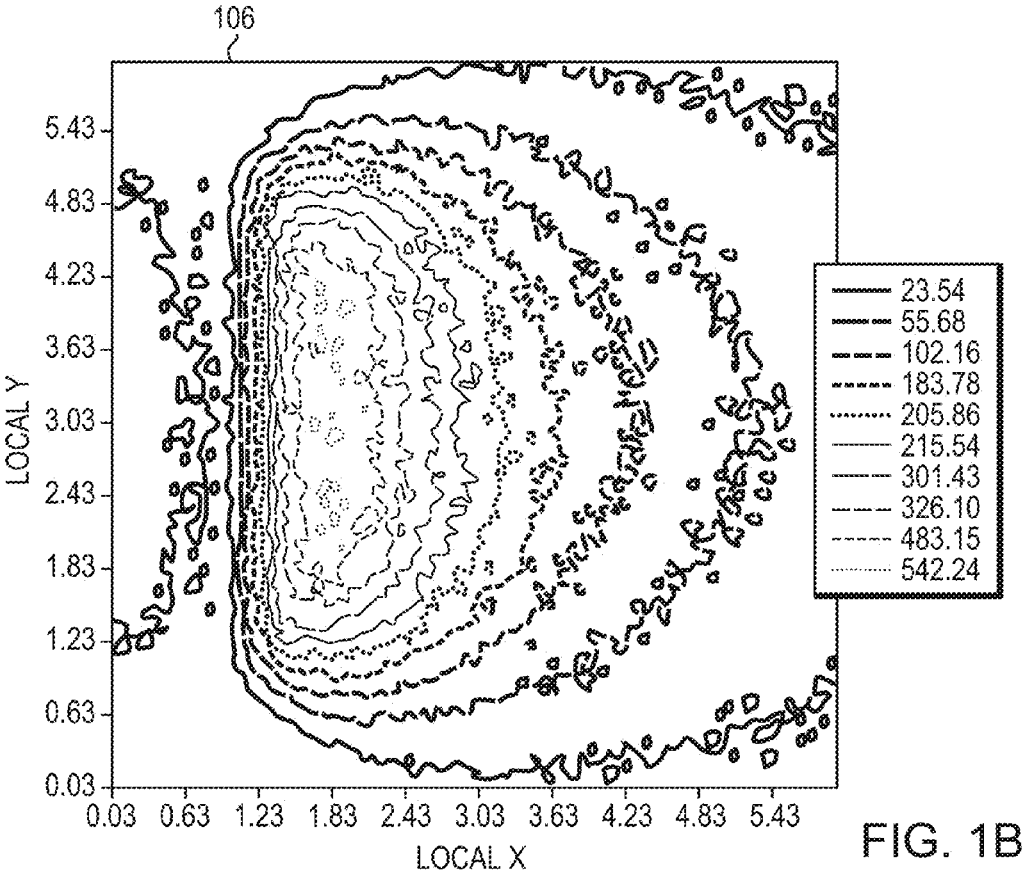
Figure 2A:
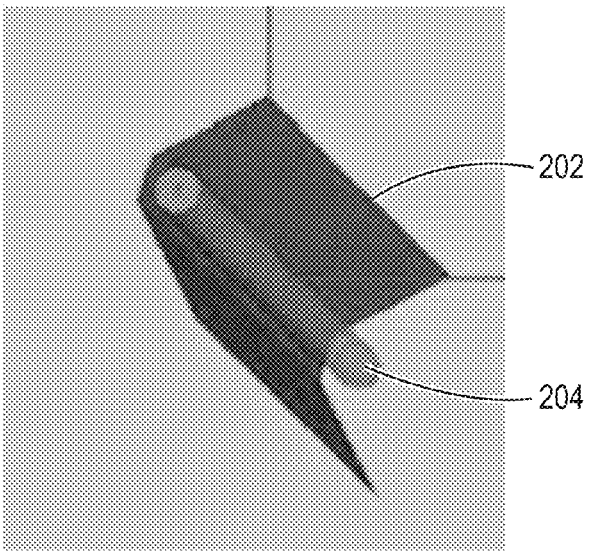
FIGS. 2A and 2B illustrate a prior art light device and a contour plot of illumination generated thereby, respectively.
Figure 2B:
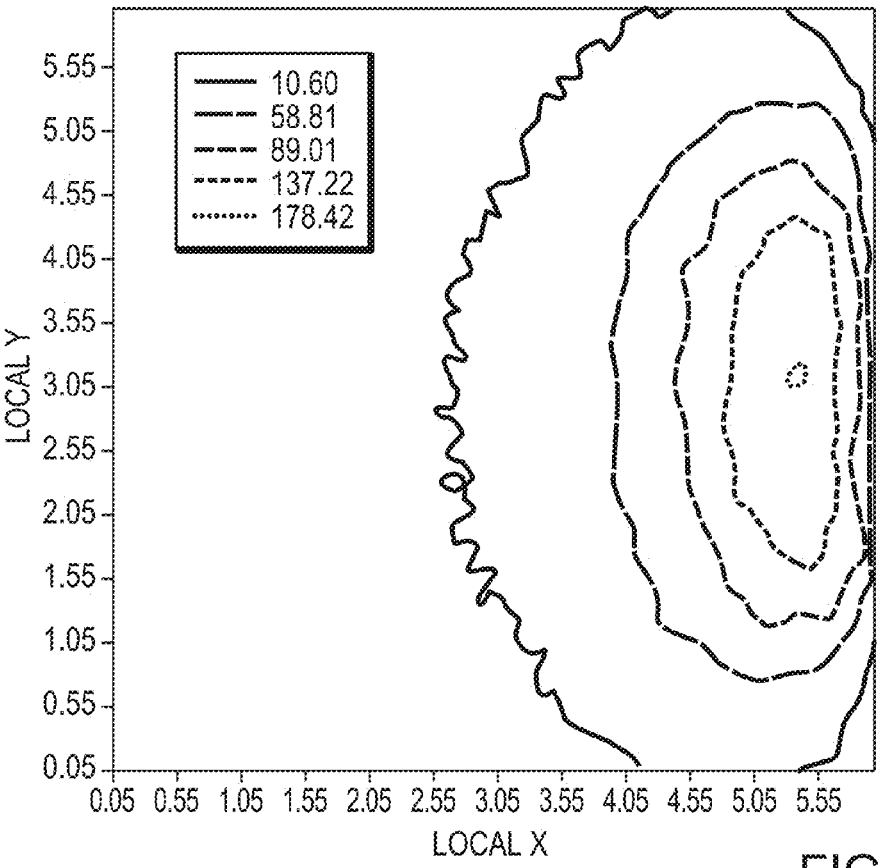
Figure 3A:
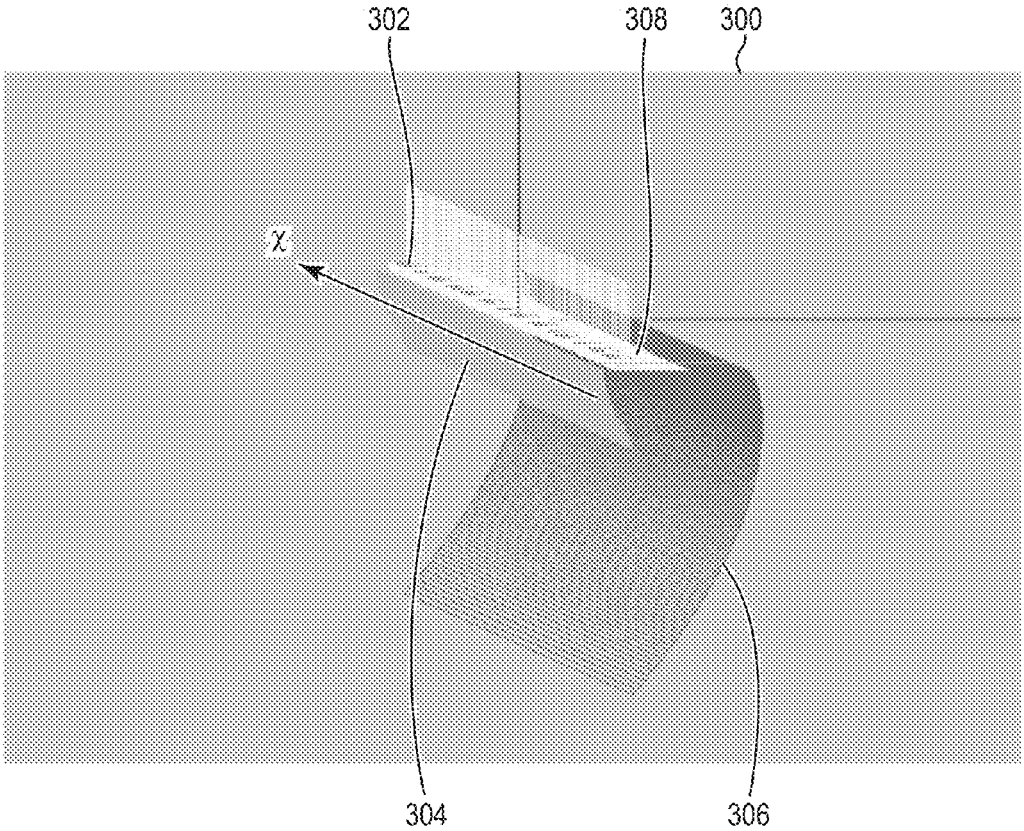
FIG. 3A schematically illustrates the components of a light device in accordance with various embodiments of the present invention.

Referring to FIG. 3A, in various embodiments, the light device 300 includes a light source 302, a primary reflector 304, and a secondary reflector 306 facing the primary reflector 304; the reflective surface area of the primary reflector 304 is typically less than that of the secondary reflector 306 (e.g., by a factor of three or greater) to avoid blocking the light exiting from the secondary reflector 306. The light source 302 preferably includes a linear array of small light-emitting diodes (LEDs) disposed (e.g., as dies) on a substrate 308 for providing a high light output (e.g., 40 lm/cm). The LEDs may be spaced sufficiently close together to form a substantially continuous "line source" such that the light emitted therefrom is uniform along the length thereof. Alternatively, the light source 302 may include a single large LED die or multiple parallel linear LED arrays disposed on the substrate 308. Preferably, the LED array 302 does not include built-in optics (e.g., collimating lens) that may collimate the light and direct the light independent of the two reflectors 304, 306. The primary and secondary reflectors 304, 306 are long, linear reflectors (e.g., extrusions) running parallel to the linear arrangement of the LEDs (i.e., in the x direction) for redirecting light emitted from the LED array 302.

Figure 3B:
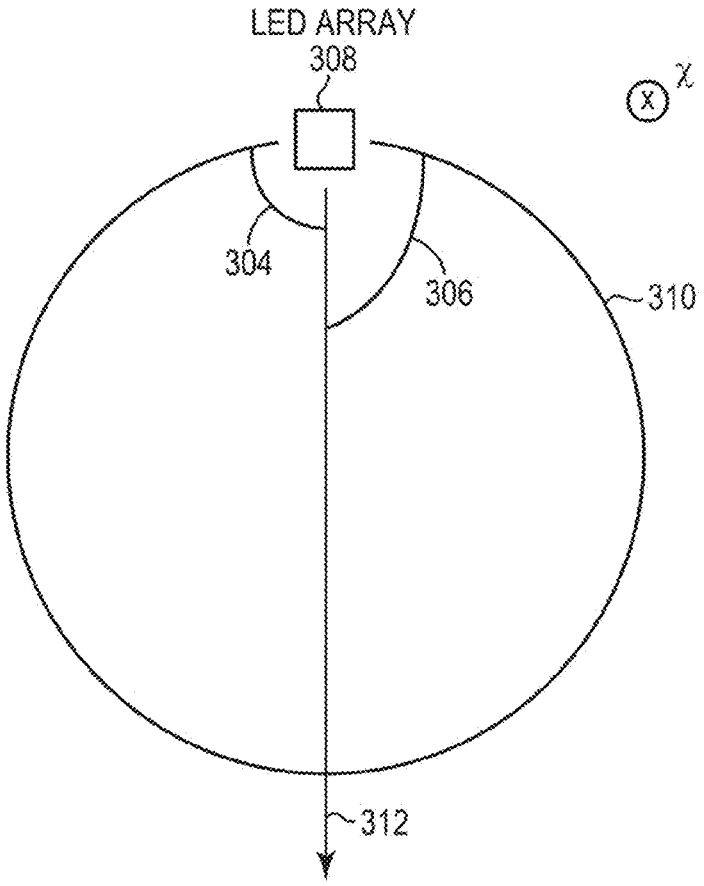
FIG. 3B depicts a distribution of luminous intensity emitted from a light source in accordance with various embodiments of the present invention.

FIG. 3B shows how the light output of the LED array 302 may emanate over a $2\pi$ steradian solid angle (i.e., approximately a half sphere) 310 symmetric with respect to the surface normal 312 thereof. Each of the primary and secondary reflectors 304, 306 may subtend an angle of approximately 90°, measured from the center of the LED array 302. Thus, each of the primary and secondary reflectors 304, 306 may intercept approximately half the light emitted by the LED array 302. In one embodiment, the primary and secondary reflectors 304, 306 are configured such that the sum of the subtended angles is 180° or less and the corresponding portions of light that the reflectors 304, 306 intercept collectively amount to substantially all (or at least 80%, and preferably at least 90%) of the light emitted from the LED array 302 into the half sphere 310. Utilization of the two or more reflectors 304, 306, therefore, provides nearly total energy transfer and redistribution on the target surface and avoids light escape and waste.

Figure 4A:
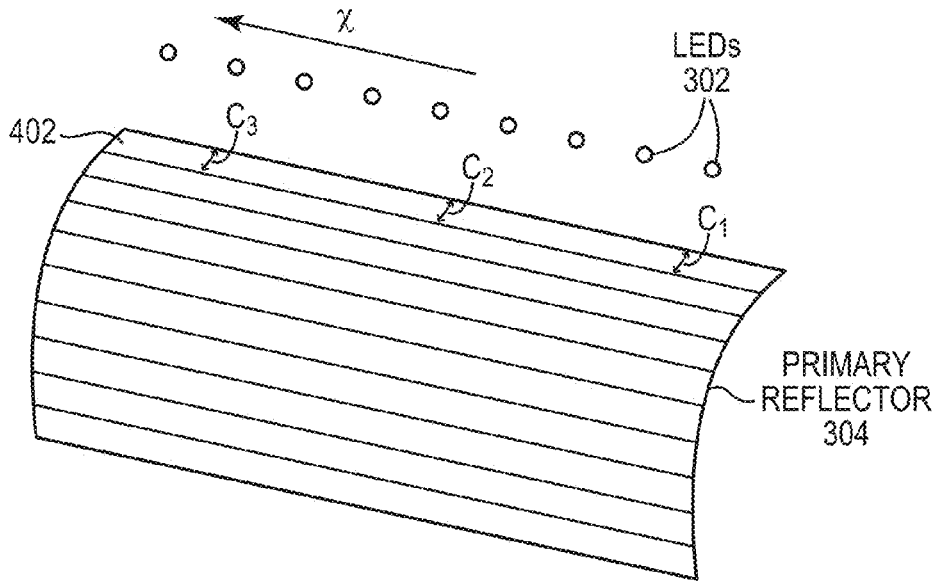
FIG. 4A depicts a primary reflector having one or more segments in accordance with various embodiments of the present invention.
Figure 4B:
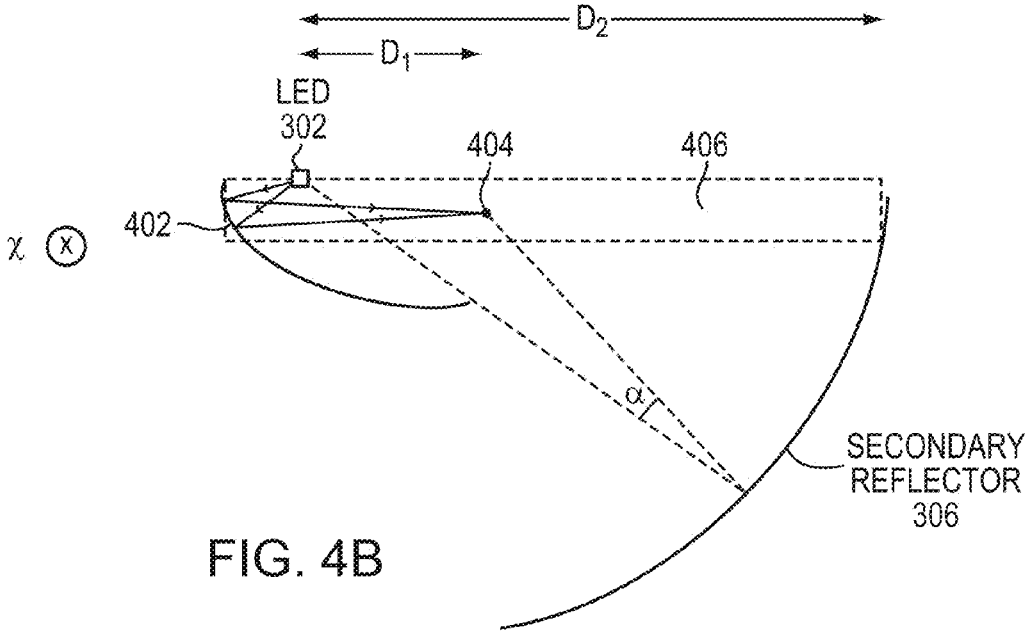
FIGS. 4B and 4C schematically illustrate spatial arrangements of a primary reflector, a secondary reflector and a light source in accordance with various embodiments of the present invention.
Figure 4C:
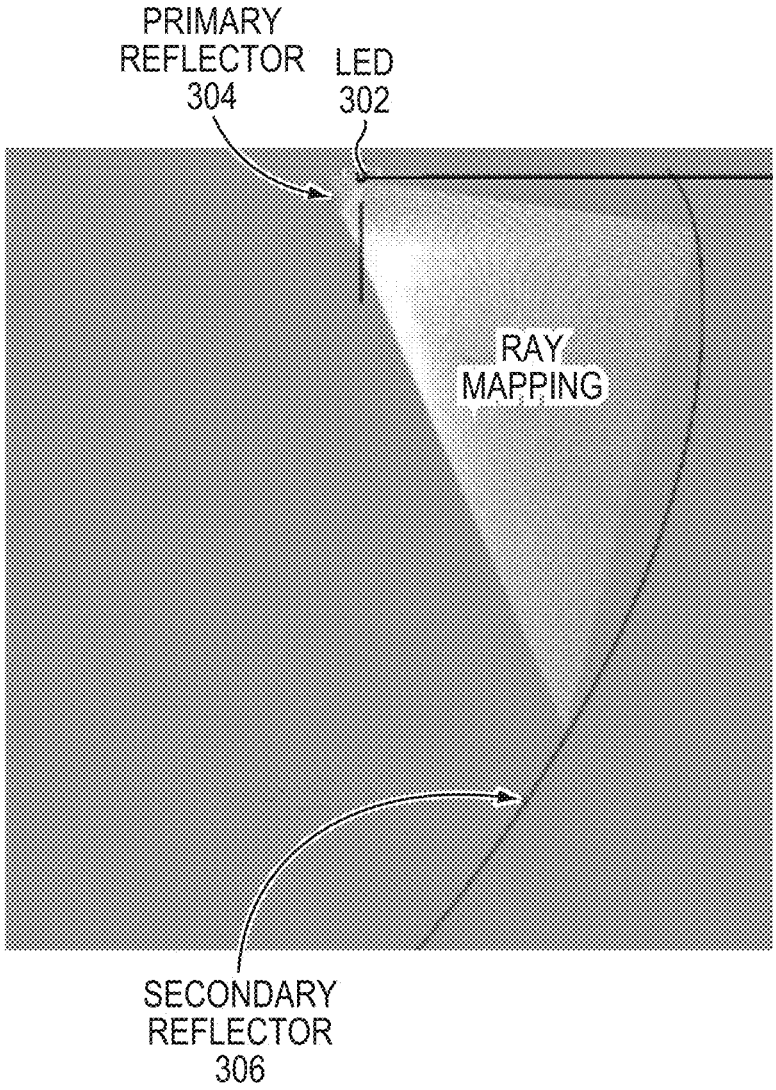

Referring to FIGS. 4A-4C, the primary reflector 304 may include one or more segments 402; each segment may have an elliptical surface profile and a substantially constant transverse dimension (e.g., $c_1=c_2=c_3$). By placing the LED array 302 coincident with one of the geometrical conjugate foci of the elliptical segment 402, a portion of light emitted from the LED array 302 is directly intercepted (i.e. without any intervening reflection and/or scattering by other objects) and reflected by the segment 402. The light directly intercepted and reflected by the segment 402 then passes through the other geometrical focus 404 of the elliptical segment 402. The conjugate focus 404 is preferably located along a line of sight 406 between the primary reflector 304 and secondary reflector 306.

Figure 4D:
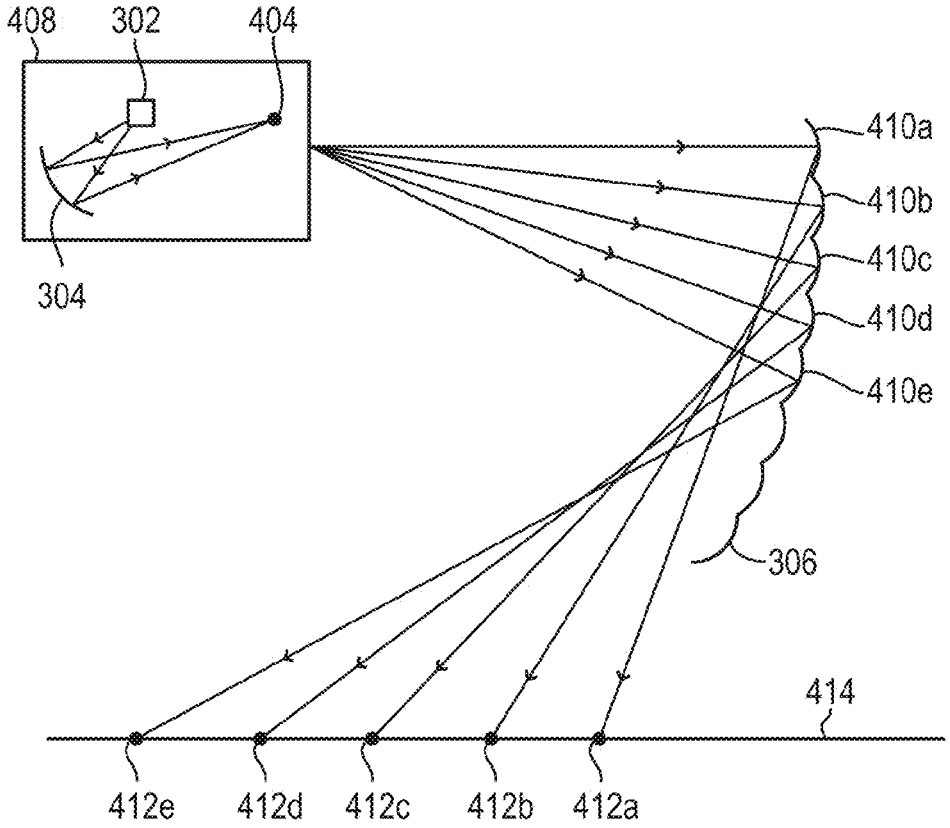
FIGS. 4D and 4E depict a secondary reflector having multiple segments for providing uniform illumination on a target plane in accordance with various embodiments of the present invention.
Figure 4E:
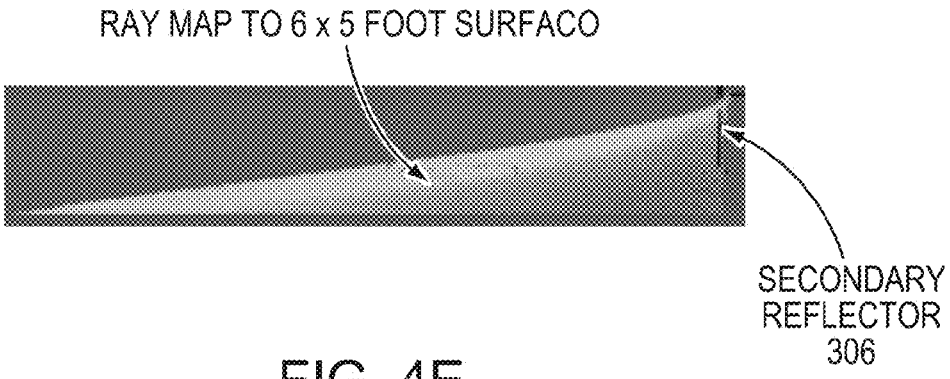

In various embodiments, the secondary reflector 306 is placed far from the array 302 and the second focus 404 of the primary reflector 304. For example, the distance $D_1$ between the second focus 404 of the primary reflector 304 and the LED array 302 is smaller (e.g., at most one-third) than the distance $D_2$ between the base of the secondary reflector 306 and the LED array 302; this constrains an angle, $\alpha$, included between line of sight from any point on the secondary reflector 306 to the LED array 302 and to the focus 404 of primary reflector 304 to be less than 10°. Referring to FIGS. 4D and 4E, this arrangement allows light emitted from the LED arrays 302 and light directed by the primary reflector 304 and subsequently passing through the second focus 404 to be recognized by the secondary reflector 306 as substantially originating from an effective single location 408.

As illustrated in FIG. 4D, in some embodiments, the secondary reflector 306 includes multiple elliptical segments 410*a*, 410*b*, 410*c*, 410*d*, 410*e*; each segment has an elliptical surface profile and a substantially constant transverse cross-section. Preferably, the elliptical segments 410*a*-410*e* share a common geometrical focus located at a single location 408 (which substantially coincides with the LED array 302 and the second focus 404 of the primary reflector 304) and have their other foci 412*a*, 412*b*, 412*c*, 412*d*, 412*e*, respectively, distributed over the target surface 414. Accordingly, light emitted from the effective location 408, including light directed from the primary reflector 304 that subsequently passes through the focus 404 as well as the second portion of light emitted from the LED array 302 that is not intercepted and reflected by other objects before being intercepted by the secondary reflector 306 is collected by the elliptical segments 410*a*-410*e* and redirected to their corresponding second foci 412*a*-412*e*, respectively, on the target surface 414. This design may thus provide uniform illumination on the target surface 414.

Although the primary reflector 304 preferably has an elliptical surface profile, it can be a reflector of any surface shape. Generally, as long as the spatial arrangements of the LED array 302, primary reflector 304 and secondary reflector 306 satisfy the following conditions, light emitted from the LED array 302 may be redirected to generate uniform illumination distributed over the target surface 414: (a) the primary reflector redirects light emitted from the LED array 302 to a space between the primary and secondary reflectors. (b) the distance between the secondary reflector 306 and the LED array 302 is much longer (e.g., at least three times) than the distance between the primary reflector 304 and the LED array 302 such that light from the primary reflector 304 and the LED array 302 can be recognized by the secondary reflector 306 as originated from an effective single location, and (c) the effective single location coincides with the common shared focus of the elliptical segments of the secondary array 306.

Figure 5:
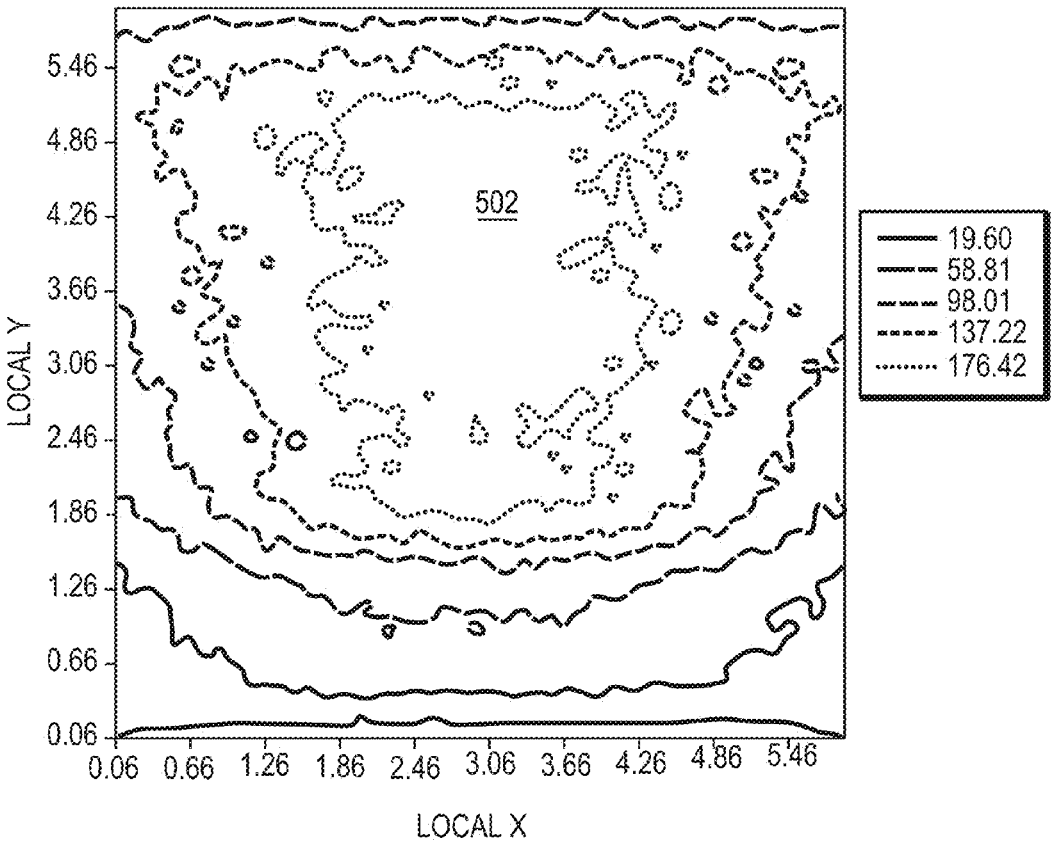
FIG. 5 depicts highly uniform illumination on a target surface generated by a light device source in accordance with various embodiments of the present invention.

Referring again to FIGS. 3A and 3B, the luminous intensity emitted from the LED array 302 is proportional to the cosine of the angle between the observer's line of sight and the surface normal 312 of the LED array 302 (i.e., Lambertian distribution or Cosine distribution). Thus, based on light emitted from the LED array 302 available to the reflectors 304, 306, each elliptical segment thereof may be sized, curved, and/or oriented to uniformly illuminate the target surface 414. In addition, the location of the target surface and/or space between the primary and secondary reflectors 304, 306 may be selected to minimize the interference effect and achieve optimal luminous uniformity. FIG. 5 illustrates the luminous distribution of a large target region (2×2 $m^2$) located at a short distance (e.g., 30 centimeters) away from the light device 300. The highly uniform illumination is achieved at the central region 502 with a sharp fall-off occurring outside of the central region 502. Accordingly, embodiments the current invention can effectively, efficiently and uniformly illuminate a desired region.

Figure 6:
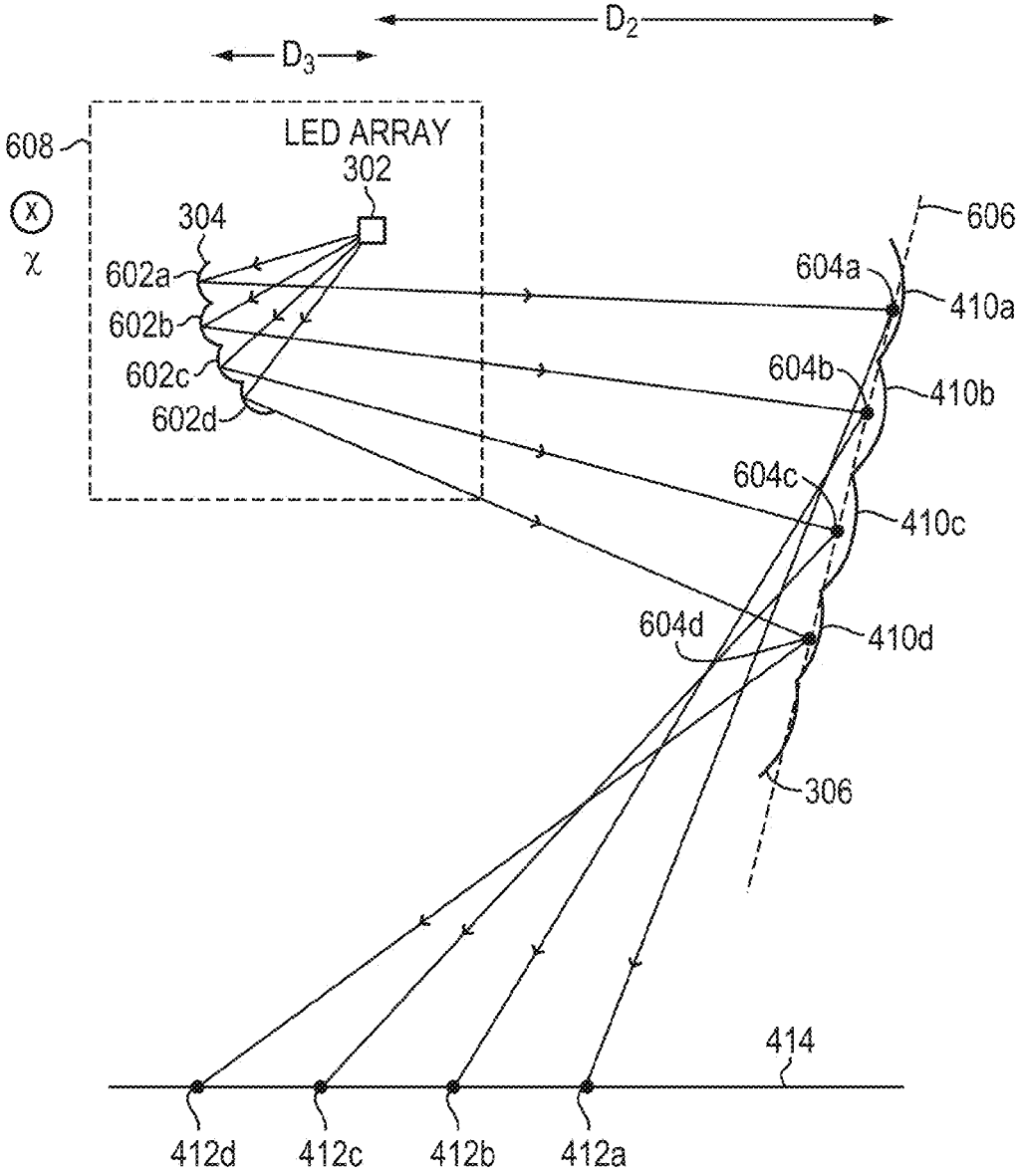
FIG. 6 schematically illustrates the components of a light device in accordance with various embodiments of the present invention.

Referring to FIG. 6, in another embodiment, the primary reflector 304 includes multiple elliptical segments 602*a*, 602*b*, 602*c*, 602*d*; again, each segment has an elliptical surface profile and a substantially constant transverse cross-section. Additionally, the elliptical segments 602*a*-602*d* share a common geometrical focus coincident with the LED array 302, and have their other foci 604*a*, 604*b*, 604*c*, 604*d*, respectively, located approximately at the secondary reflector 306 (e.g., within 5% of $D_2$ in front of or behind the secondary reflector 306 or on the reflector 306). Thus, a first portion of light emitted from the LED array 302 is directly intercepted and reflected by the segments 602*a*-602*d* of the primary reflector 304 and passes through the conjugate foci 604*a*-604*d*, respectively. Preferably, the foci 604*a*-604*d* form a line 606 that is roughly tangent to the curve of the secondary reflector 306. In one implementation, each segment of the primary reflector 304 directs light from the LED array 302 onto a corresponding segment of the secondary reflector 306, and different segments of the primary reflector 304 direct the light onto different segments of the secondary reflector 306. For example, the segment 602*a* of the primary reflector 304 directs light to the corresponding segment 410*a* of the secondary reflector 306 only, whereas the segment 602*d* directs light to the corresponding segment 410*d* only.

In various embodiments, the secondary reflector 306 is placed far from the LED array 302 and the primary reflector 304. For example, the distance $D_3$ between the base of the primary reflector 304 and the LED array 302 is much smaller (e.g., at most one-third) than the distance $D_2$ between the base of the secondary reflector 306 and the LED array 302. Thus, while the first portion of light emitted by the LED array 302 is directly intercepted by the primary reflector 304, a second portion of light emitted from the LED arrays 302 passes directly to the secondary reflector 306 without being intercepted by other objects. Regardless of whether the light emitted by the LED arrays 302 is reflected before reaching the secondary reflector 306, the light from the LED arrays 302, when reaching the secondary reflector 306, can be treated as being substantially emitted from a single location 608. Again, because the elliptical segments 410*a*-410*d* share a common geometrical focus coincident with the location 608 and have their other foci 412*a*-412*d* distributed over the target surface 414, light emitted from location 608 may be redirected by the secondary reflector 306 to create uniform illumination over the target surface 414. In this design, because the primary reflector 304 uniformly redistributes light emitted from the LED array 302 over the secondary reflectors 306 via the conjugate foci 604*a*-604*d*, illumination uniformity of light reflected by the secondary reflector 306 onto the target region 414 may be consequently increased.

Once again, although the segments of the primary and secondary reflectors 304, 306 preferably have an elliptical surface profile, they may be reflectors of any surface shape. For example, the segments 602*a*-602*d* of the primary reflector 304 may be configured to redirect light from the LED array 302 to illuminate the second reflector 306 uniformly, and the segments 410*a*-410*e* of the secondary reflector 306 may be configured to redirect light emitted thereat, including light directly emitted from the LED arrays 302 and light redirected by the primary reflector 304, to illuminate the target surface 414 uniformly. Accordingly, any designs that cause light emitted from the LED array 302 to illuminate the secondary reflector 306 uniformly, and consequently cause light reflected by the secondary reflector 306 to illuminate the target region 414 uniformly are within the scope of the current invention.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. For example, while the invention has been described with respect to embodiments utilizing LEDs, light sources incorporating other types of light-emitting devices (including, e.g., laser, incandescent, fluorescent, halogen, or high-intensity discharge lights) may similarly achieve variable beam divergence if the drive currents to these devices are individually controlled in accordance with the concepts and methods disclosed herein. Accordingly, the described embodiments are to be considered in all respects as only illustrative and not restrictive.

What is claimed is:

1. A device for uniform illumination of a target surface, comprising:

a linear light source;

a primary reflector extending parallel to at least a portion of the linear light source and having a substantially constant transverse cross-section; and facing the primary reflector and extending parallel to at least a portion of the linear light source, a secondary reflector having a substantially constant transverse cross-section, wherein the light source, the primary reflector, and the secondary reflector are arranged such that the primary reflector directly intercepts and reflects a first portion of light emitted by the light source to cause substantially uniform illumination of the secondary reflector and the secondary reflector directly intercepts and reflects a second portion of light emitted by the light source as well as the light intercepted and reflected by the primary reflector to cause substantially uniform illumination of the target surface.

2. The device of claim 1, wherein the primary reflector comprises at least one elliptical segment having a focus coincident with the light source and the secondary reflector comprises a plurality of elliptical segments having a common first focus located at the light source and different second foci distributed over the target surface.

3. The device of claim 2, wherein the primary reflector comprises a plurality of elliptical segments having a common focus coincident with the light source and different second foci distributed over the secondary reflector, thereby causing substantially uniform illumination of the secondary reflector.

4. The device of claim 3, wherein the second foci of the primary reflector form a line that is approximately tangent to a curve of the secondary reflector.

5. The device of claim 3, wherein each segment of the primary reflector directs light from the light source onto a corresponding segment of the secondary reflector, different segments of the primary reflector directing the light onto different segments of the secondary reflector.

6. The device of claim 3, wherein the common first focus of the secondary reflector is located substantially at the light source and also at the primary reflector.

7. The device of claim 6, wherein a distance between the secondary reflector and the light source exceeds a distance between the primary reflector and the light source by a factor of at least three.

8. The device of claim 1, wherein the segments of the primary reflector and the secondary reflector are sized, curved, and oriented to cause uniform illumination of the target surface.

9. The device of claim 1, wherein the primary and secondary reflectors are configured such that the first and second portions of light collectively amount to substantially all the light emitted by the light source into a half sphere.

10. The device of claim 9, wherein each of the primary and secondary reflectors subtends an angle of approximately 90°, measured from the center of the light source, thereby intercepting about half of the light emitted by the light source.

11. The device of claim 1, wherein a reflective surface area of the primary reflector is less than one-third of a reflective surface area of the secondary reflector.

12. The device of claim 11, wherein the target surface is planar.

13. The device of claim 1, wherein the light source comprises a linear arrangement of light-emitting diodes.

14. A method for uniform illumination of a target surface, comprising:

directly intercepting and reflecting a first portion of light emitted by a light source, using a primary reflector, to cause substantially uniform illumination of a reflective surface of a secondary reflector; and directly intercepting and reflecting a second portion of light emitted by the light source as well as the light intercepted and reflected by the primary reflector, using the secondary reflector, to cause substantially uniform illumination of the target surface.

15. The method of claim 14, wherein the secondary reflector comprises a plurality of foci distributed over the target surface, thereby causing substantially uniform illumination of the target surface.

16. The method of claim 14, wherein the primary reflector comprises a plurality of foci distributed over the secondary reflector, thereby causing uniform illumination of the reflective surface of the secondary reflector.

17. The method of claim 14, wherein the first and second portions of light collectively amount to substantially all the light emitted by the light source into a half sphere.

18. The method of claim 17, wherein each of the primary and secondary reflectors intercepts about half of the light emitted by the light source.

* * * * *